US006044624A

United States Patent [19]

Focke et al.

[11] Patent Number: 6,044,624

[45] Date of Patent: Apr. 4, 2000

[54] PROCESS AND APPARATUS FOR PRODUCING (FILLING) BAG PACKS FOR TOBACCO

[75] Inventors: Heinz Focke, Verden; Thomas Häfker, Langwedel; Burkard Roesler, Blender, all of Germany

[73] Assignee: Focke & Co. (GmbH & Co.), Verden, Germany

[21] Appl. No.: 09/054,376

[22] Filed: Apr. 2, 1998

[30] Foreign Application Priority Data

Apr. 7, 1997 [DE] Germany ..... 197 14 245

[51] Int. Cl.[7] ..... B65B 1/24

[52] U.S. Cl. ..... 53/438; 53/455; 53/469; 53/502; 53/529; 53/562

[58] Field of Search ..... 53/253, 438, 455, 53/459, 469, 529, 562, 570, 202, 51, 284.7, 502; 100/232, 42

[56] References Cited

U.S. PATENT DOCUMENTS

| | | | |
|---|---|---|---|
| 2,915,866 | 12/1959 | Bartlo | 53/124 |
| 3,091,903 | 6/1963 | Kammerer | 53/260 |
| 3,543,466 | 12/1970 | Forsberg | 53/415 |
| 4,583,352 | 4/1986 | Heron | 53/570 |
| 4,607,479 | 8/1986 | Linden | 53/530 |
| 4,680,024 | 7/1987 | Focke et al. | 493/197 |
| 4,696,146 | 9/1987 | Esch et al. | 53/529 |
| 4,754,593 | 7/1988 | Ishihara et al. | 53/51 |
| 4,757,668 | 7/1988 | Klinkel et al. | 53/451 |
| 5,425,215 | 6/1995 | Lewis et al. | 53/170 |
| 5,459,982 | 10/1995 | Long | 53/529 |
| 5,727,366 | 3/1998 | Manly, Jr. | 53/451 |

FOREIGN PATENT DOCUMENTS

| | | |
|---|---|---|
| 0255474B1 | 2/1988 | European Pat. Off. . |
| 2237430A | 2/1975 | France . |
| PS427579 | 4/1926 | Germany . |
| AS1034092 | 7/1958 | Germany . |
| 2338374C2 | 2/1974 | Germany . |
| 2405691B2 | 8/1974 | Germany . |
| 2655036A1 | 6/1978 | Germany . |
| 3335754A1 | 4/1985 | Germany . |
| 3409263C2 | 9/1985 | Germany . |
| 3721675A1 | 1/1989 | Germany . |
| 4111786A1 | 1/1992 | Germany . |
| 9203841 U 1 | 5/1992 | Germany . |

*Primary Examiner*—Ed Tolan
*Attorney, Agent, or Firm*—Abelman, Frayne & Schwab

[57] ABSTRACT

Process and apparatus for producing bag packs each having a portion (10) of cut tobacco or the like. For the purpose of producing bag packs with portions (10) of different weights, the portions (10) are compressed in the region of a pressing chamber (14) such that the portion (10) which has to be introduced into the bag (11) is always of the same size—irrespective of the weight. During compaction, the portion (10) is simultaneously formatted so that it corresponds to the interior of the bag (11).

5 Claims, 8 Drawing Sheets

PROCESS AND APPARATUS FOR PRODUCING (FILLING) BAG PACKS FOR TOBACCO

DESCRIPTION

Figure 1:
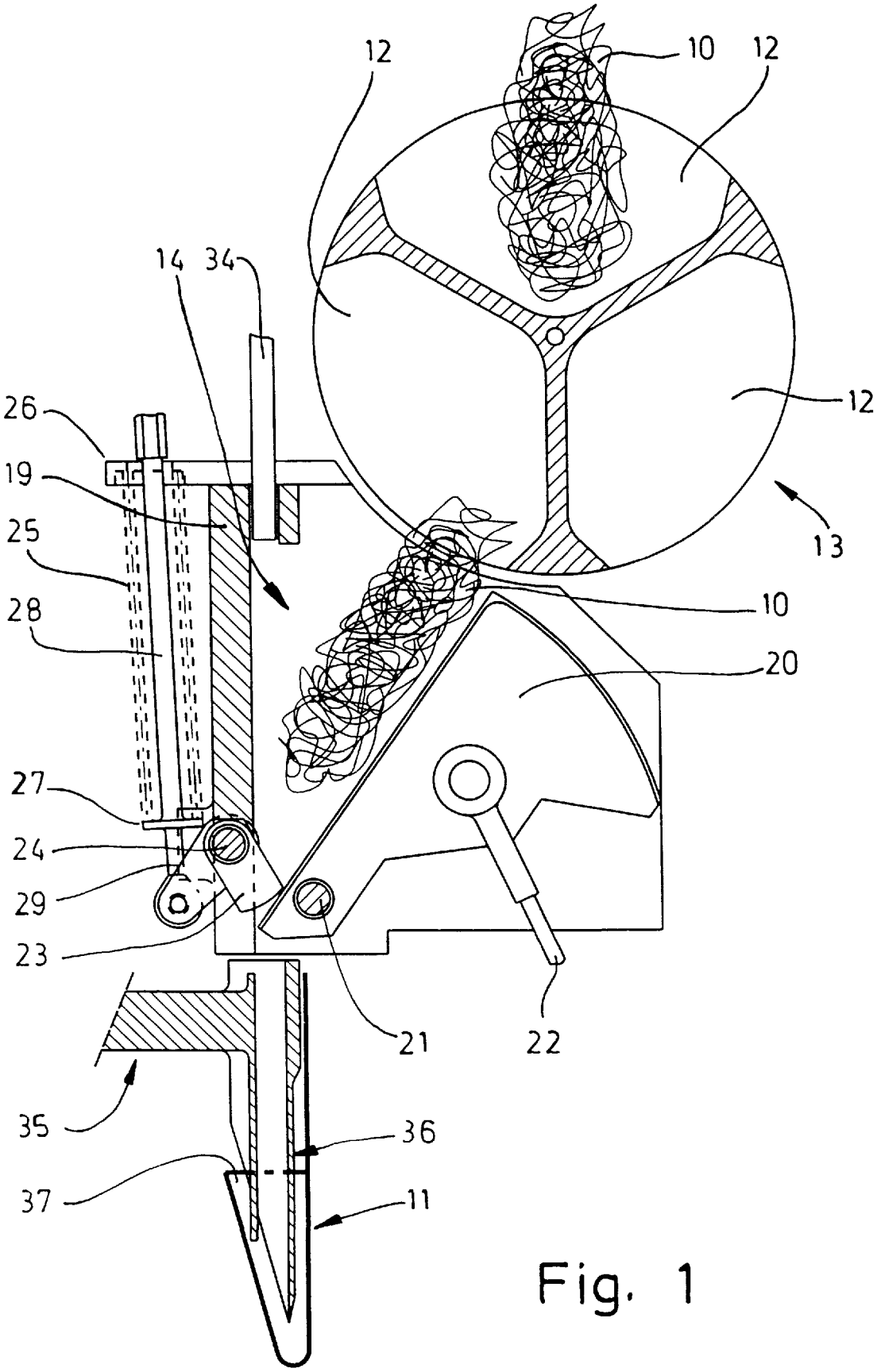

The invention relates to a process for producing bag packs each having a portion of fibrous material, in particular (cut) tobacco, it being the case that a portion which is measured out by weight or quantity is compressed and introduced into a container which is open at the top, and said container is then closed. The invention also relates to an apparatus for carrying out the process.

Bag packers for fibrous contents, in particular for portions of cut tobacco, are known (DE 34 09 263). Precisely measured-out portions of the tobacco are introduced into a pressing chamber and, once they have been compacted, are introduced into a bag which is open at the top. The latter is then closed, in the region of an introduction opening, by a transversely directed seam.

Practical requirements call for further developments in terms of performance of such bag packers. Accordingly, the object of the invention is to improve bag packers, and the operation thereof, so as to provide a higher output and a broader range of application.

In order to achieve this object, the inventive process for producing and/or filling bag packs is characterized in that, for (tobacco) portions of different sizes, use is made of bags of standard size, and the portion is compressed such that it fills the bag irrespective of the portion size.

This fulfills an important practical concern, namely the requirement of using one and the same machine for producing bag packs which—depending on market requirements—have different contents in terms of quantity/size. The solution according to the invention provides for simplification in two respects: on the one hand, the bag packs with different contents can be produced and/or filled in one and the same machine. On the other hand, despite contents which differ in terms of portion size, use can be made of bags which are standard in terms of size and shape. Accordingly, greater compacting is provided for larger quantities and less pronounced compacting is provided for smaller portions.

A further special feature of the invention consists in measures during closure of the filled bags. The (flat) bag is compressed in the region above the contents. Thereafter, the closure seam is provided above the compressed region, to be precise, as a result of the compression, in a fully disruption-free manner.

The apparatus according to the invention is designed in a specific manner, namely in particular as regards pressing chambers for receiving portions. A further special feature is provided in the handling of a film web for producing the bag. The special feature consists in that, for the purpose of applying sealing seams and/or severing cuts precisely, the film web is controlled precisely and differences in length as a result of expansion of the film are compensated for automatically. For this purpose, in the region of a bag station of the apparatus, the length of film web which is actually conveyed is measured and a sealing and/or cutting unit is controlled in accordance therewith.

Figure 2:
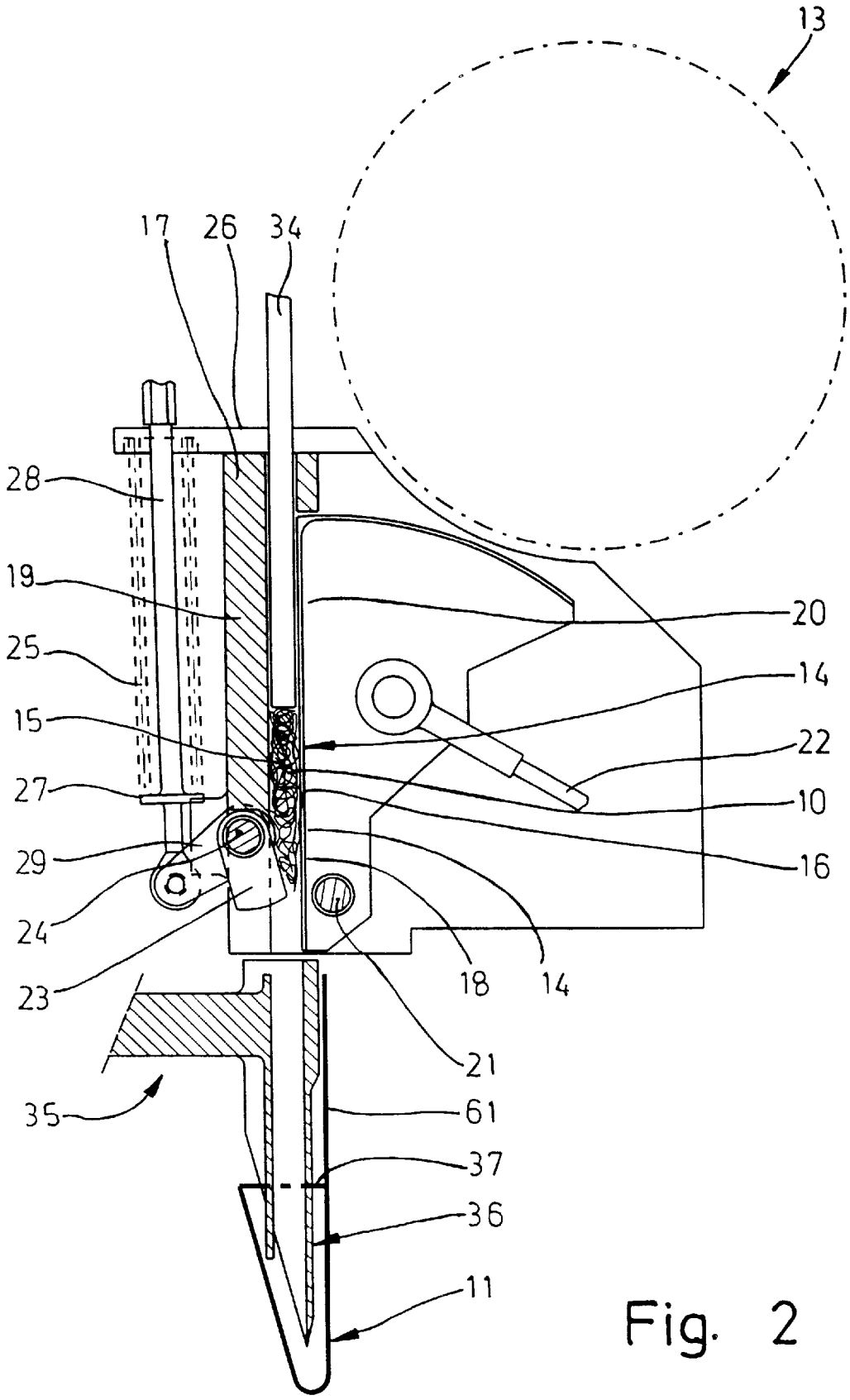
Figure 3:
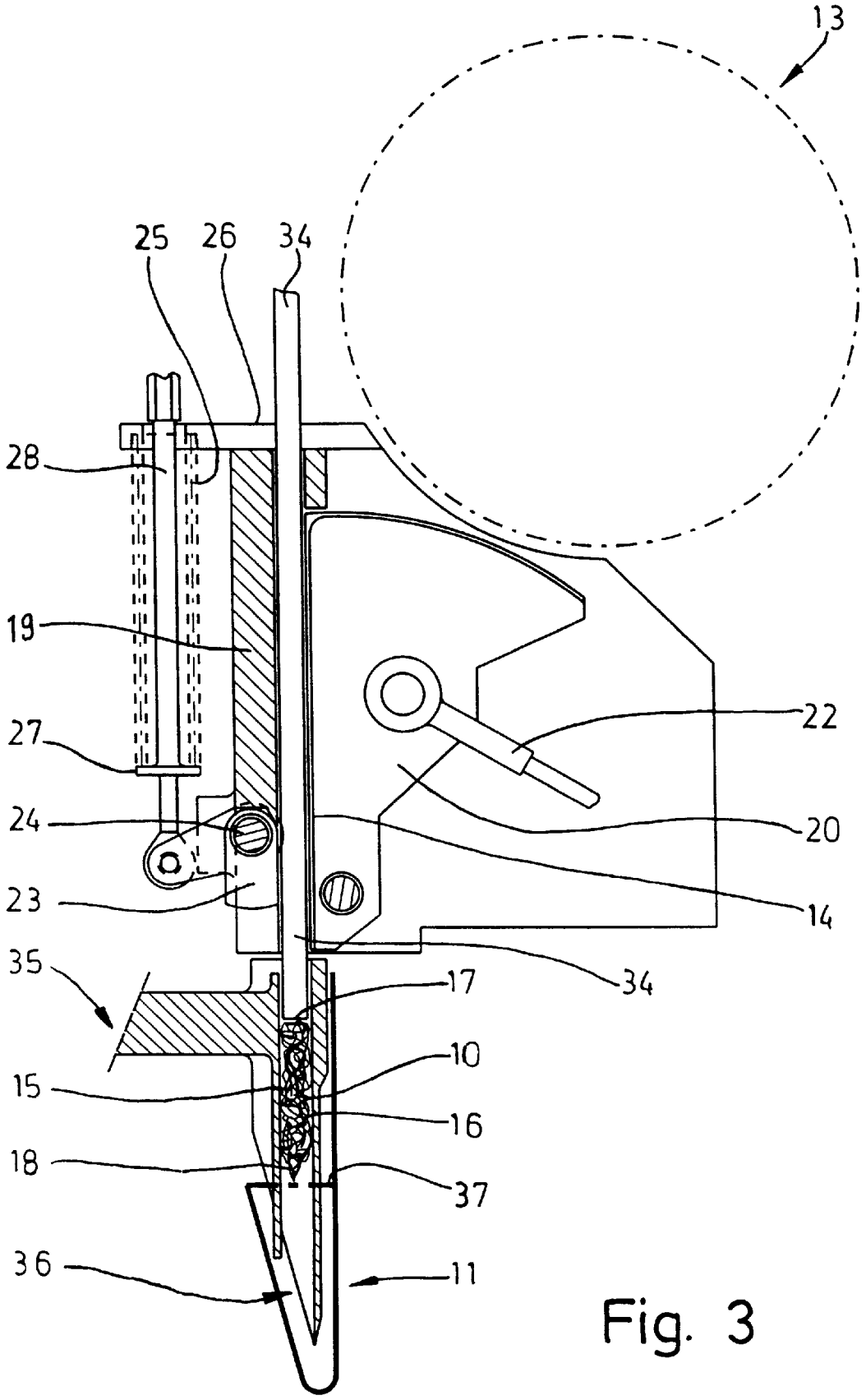
Figure 4:
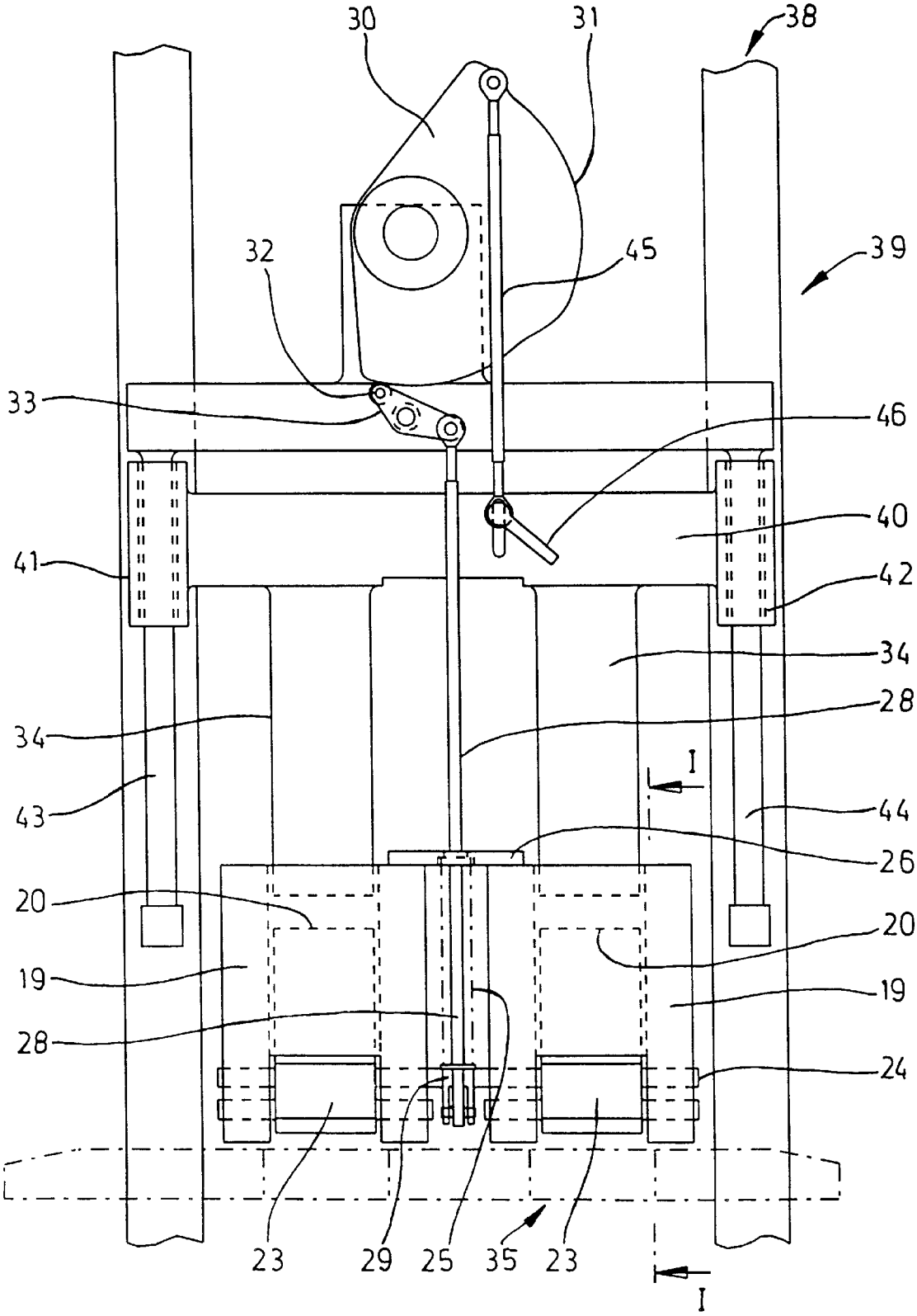
Figure 5:
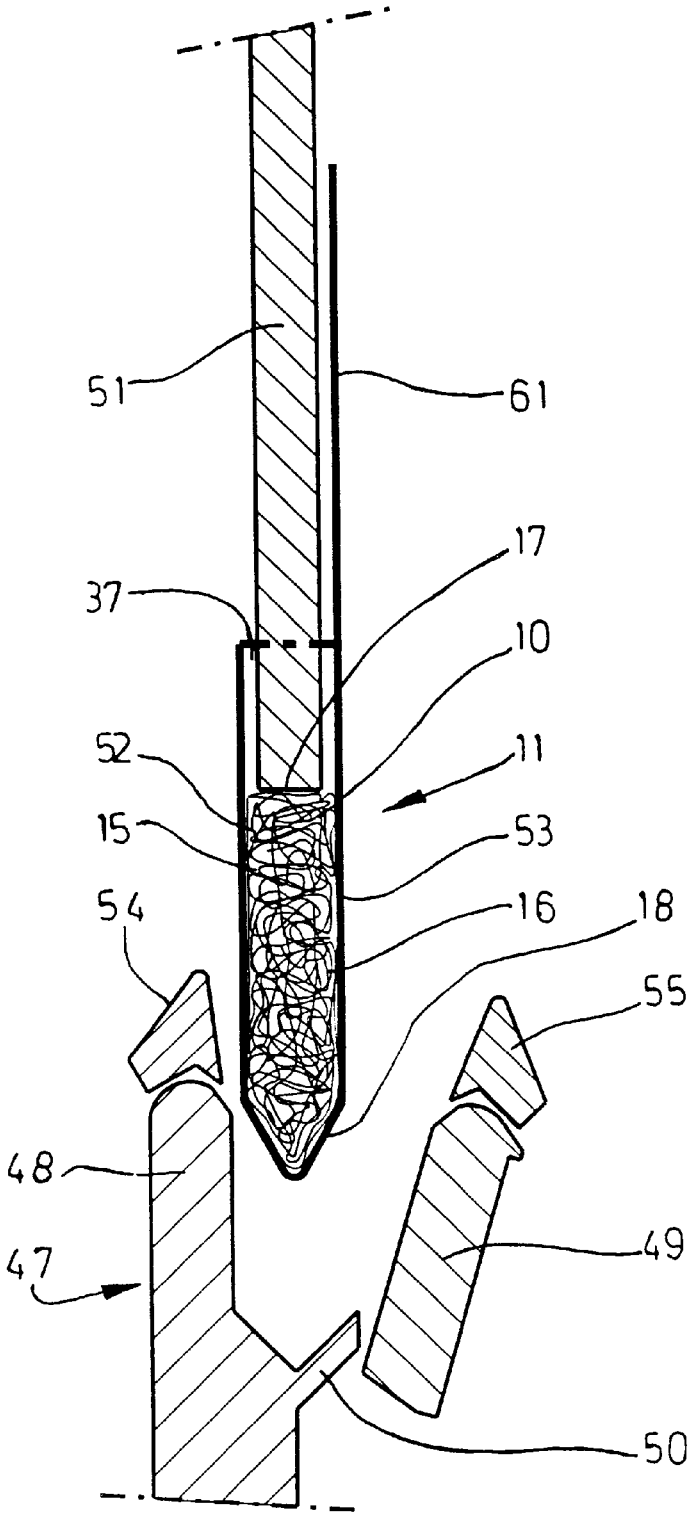
Figure 6:
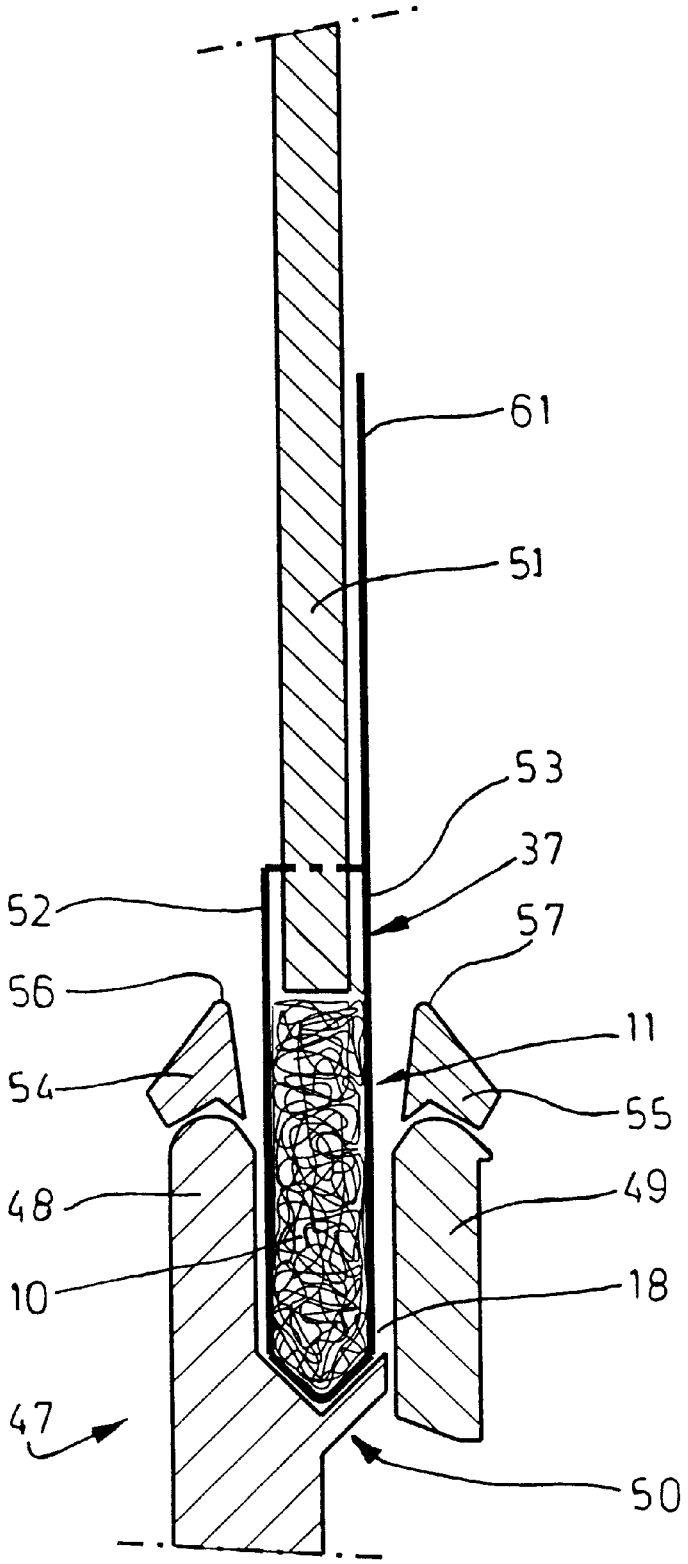
Figure 7:
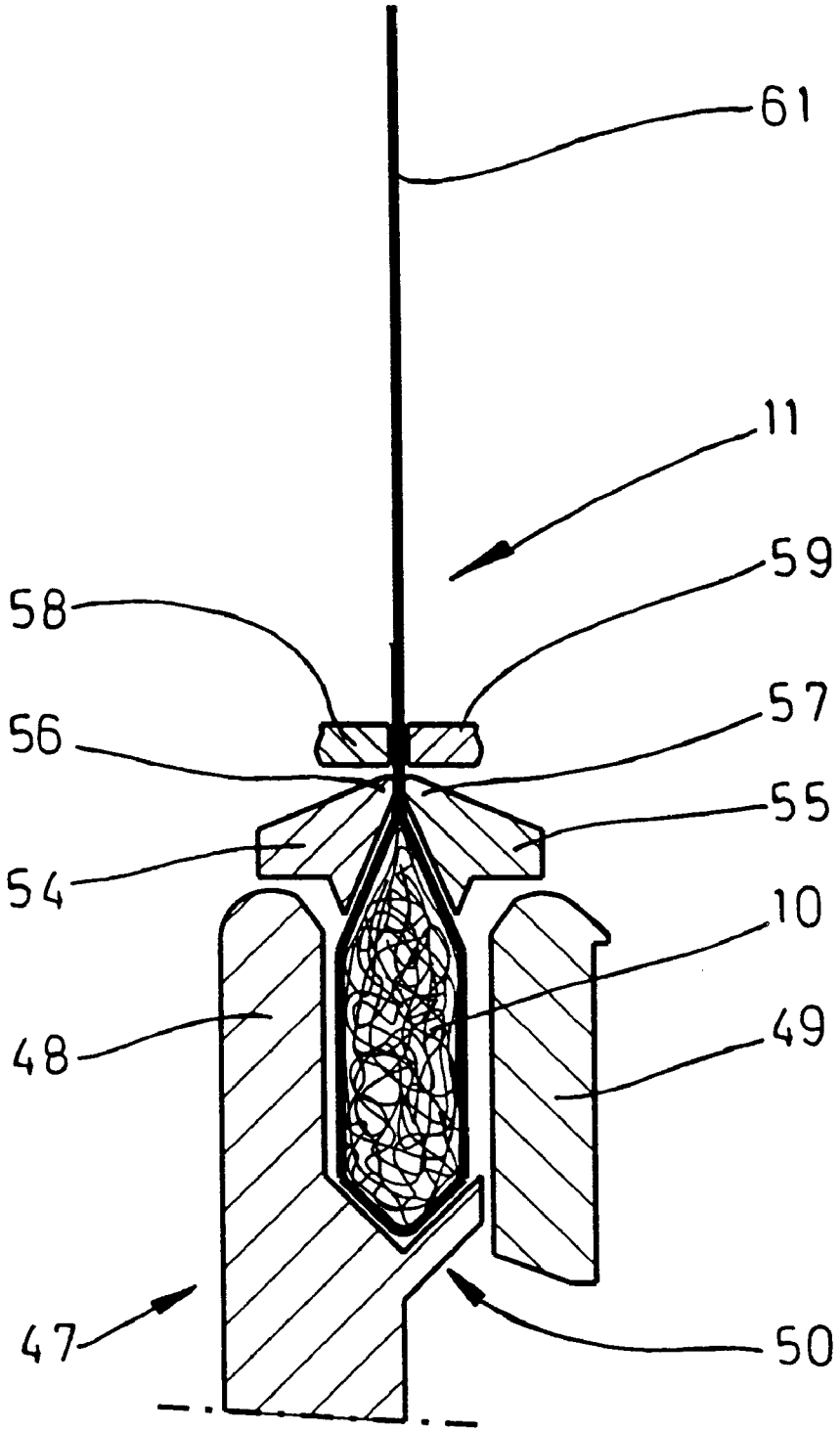
Figure 8:
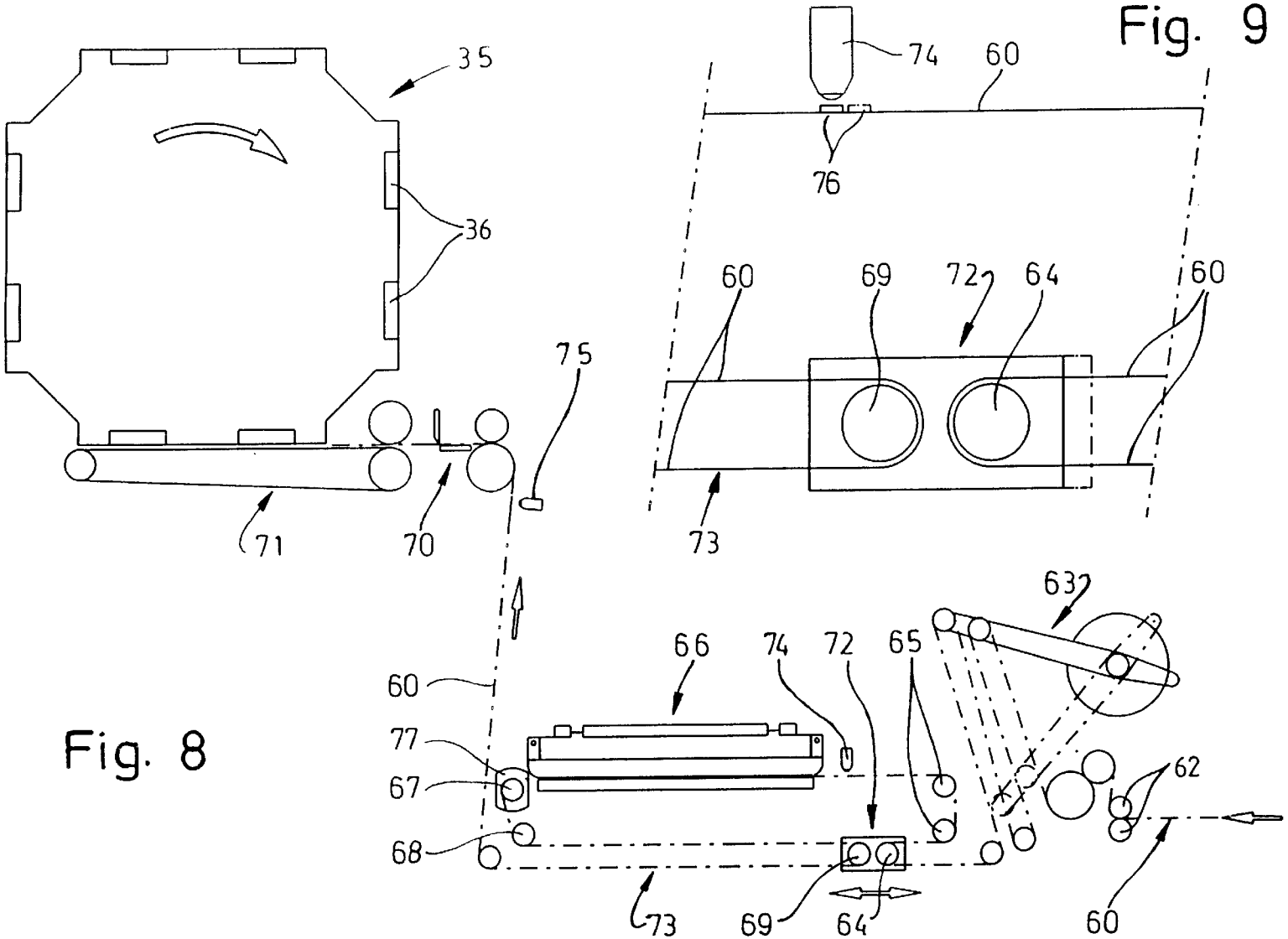

Further details of the invention are explained more fully hereinbelow with reference to exemplary embodiments illustrated in the drawings, in which:

FIG. 1 shows a detail of the apparatus, namely a filling station, in vertical section, FIG. 2 shows the units of the filling station according to FIG. 1 in the pressing position, FIG. 3 shows a position of the units according to FIGS. 1 and 2 during filling of a bag, FIG. 4 shows a plan view of the filling station according to FIGS. 1 to 3, FIG. 5 shows a detail of the apparatus in vertical section, namely the operation of preparing a bag for closure, FIG. 6 shows the detail according to FIG. 5 in a further phase of the closure operation, FIG. 7 shows the detail according to FIGS. 5 and 6 during closure of the bag, FIG. 8 shows an overall view (plan view) of an apparatus for producing and filling bags in a vastly simplified illustration, and FIG. 9 shows a detail of the apparatus according to FIG. 8, that is to say an excerpt, on a vastly enlarged scale.

In the case of the exemplary embodiments illustrated in the drawings, FIGS. 1 to 4 show details of a unit or of a filling station for preparing portions 10 of fibrous material, in particular cut tobacco, and for introducing said portion 10 into a pack, namely into a bag 11.

The portion 10, which is prepared elsewhere, namely is metered out precisely by weight, is introduced into one of a number of (three) cells 12 of a cell wheel 13, for example in accordance with DE 34 09 263. By virtue of partial rotation of the cell wheel 13, the portion 10 is introduced into a pressing chamber 14, which is open at the top. In the pressing chamber 14, the portion 10 is compressed and, at the same time, made into a specific geometrical shape (FIG. 2). This compaction•or shaping provides the portion 10 with an essentially cuboidal configuration, with two mutually opposite large side surfaces 15, 16 and a narrow, elongate top side 17. A special feature consists in that, opposite the top side 17, that is to say at the bottom, the portion 10 has a profile 18 which tapers sharply or to a point. The resulting contour corresponds to the (vertical) cross-sectional profile of the bag (FIGS. 5 to 7).

The pressing chamber 14 is assigned suitable pressing elements. The pressing chamber 14 is bounded on one side, in the region of the side surface 15, by an (upright) fixed wall 19. Arranged opposite this is a movable pressing wall 20. The latter is designed as a segment and can be pivoted about a bottom articulation or a bottom pin 21. The open position (FIG. 1) results in funnel-like positioning of the pressing wall 20, and thus in a large introduction opening towards the top. The pressing wall 20 can be moved with pivoting action, by a connecting rod 22, from the position according to FIG. 1 into the position according to FIGS. 2/3, parallel to the fixed wall 19.

The pressing chamber 14 can be closed at the bottom by a movable element, namely by a flap 23, which can be pivoted about a pin 24 connected to the fixed wall 19. In the closed position (FIGS. 1, 2), the flap 23 projects, in a downwardly directed oblique position, into the pressing chamber 14. The latter is thus closed at the bottom by an obliquely running surface. When the portion 10 is subjected to pressure by virtue of the pressing wall 20, this produces shaping corresponding to the interior of the pressing chamber 14, namely with the profile 18 which tapers to a point at the bottom. The corresponding shaping is produced by the flap 23 in the closed position.

The flap 23 is prestressed elastically, to be precise by a compression spring 25, in the direction of the closed position (FIGS. 1, 2). Said spring butts against a supporting wall 26 by way of one (top) end. The other end is supported on a protrusion or collar 27 of an actuating rod 28 for the flap 23.

By virtue of the actuating rod 28 being moved upwards, that is to say drawn upwards, the flap 23 moves, counter to the pressure of the spring 25, from the closed position (FIG. 1) into the open position (FIG. 3). For this purpose, the actuating rod 28 is connected to a lever 29 which, for its part, is provided on the flap 23 or the pin 24 thereof. A pivot movement of the lever 29—initiated by the actuating rod 28—results in the flap 23 pivoting in one direction or the other.

As is shown in FIG. 4, the actuating rod 28 is lengthened in the upward direction and is actuated by a cam segment 30. A contact roller 32 of a double-armed rocker lever 33 butts against the outer curve 31 of said cam segment. The other end of the rocker lever 33, which is mounted in a stationary manner, is connected in an articulated manner to the top end of the actuating rod 28. Accordingly, the movements of the flap 23 are executed, to be precise synchronously with the movements of other elements, by virtue of the pivot movement of the cam segment 30 and the configuration of the outer curve.

The portion 10 is compacted in the pressing chamber 14 in at least two different directions. In addition to the pressing wall 20, a press ram 34, which enters into the pressing chamber 14 from above, takes effect. The press ram 34 has the dimensions (length, width) of the pressing chamber 14 in the pressing position of the pressing wall 20. The press ram 34 acts on the top side 17 of the portion 10 and compresses the latter counter to the supporting action of the flap 23. For this purpose, the press ram 34 is moved downwards, when the pressing chamber 14 is closed, from a top, initial position according to FIG. 1, and in the process compresses the portion 10 to the size corresponding to the contents of the bag 11, this being illustrated in FIG. 2. This pressing position of the press ram 34 is constant, to be precise irrespective of the quantity (weight) of the portion 10, this always resulting in constant dimensioning of the packaging portion 10, irrespective of the quantity.

The press ram 34 has a further function. Following completion of the pressing operation and opening of the pressing chamber 14 towards the bottom by virtue of the flap 23 being pivoted back, the press ram 34 pushes the compacted portion 10 out downwards, by a continued movement, into the bag 11, which is open at the top. The latter is held on standby beneath the pressing chamber 14 by a bag turret 35, which has a downwardly directed filling mouthpiece 36 for each bag 11. Said mouthpiece is open at the top and bottom and passes into the bag via a bag opening 37. The (compacted) portion 10 is pushed by the press ram 34 as far as the filling mouthpiece 36 of the bag turret 35 (FIG. 3). Thereafter, the press ram 34 returns into the (top) initial position according to FIG. 1. The bag turret 35 can be moved on by one station.

For transferring the portion 10 to the bag 11 arranged on the filling mouthpiece 36 in another station not shown here, the portion 10 is pushed by a sliding plug or plunger out of the filling mouthpiece 36 and into the bag 11.

The bag turret 35, which can be rotated in a stepped manner about a vertical axis, is designed for doubleweb operation (FIG. 8). Accordingly, the bag turret 35 is fed in each case two bags 11, which are positioned on the bag turret 35, namely at a filling mouthpiece 36 in each case, for receiving in each case one portion 10. In each case two receiving means or mounts with filling mouthpiece 36 are located one beside the other on the bag turret 35.

Accordingly, the arrangement described above for forming the portions 10 and introducing the same into the bags 11 is also designed, as a stationary portion unit 38, for processing two portions at the same time. Two pressing chambers 14 located one beside the other are provided, on a common carrying framework 39, in the region of the stationary filling station. The pressing chambers 14 are spaced apart from one another by a distance which corresponds to the distance between the bags 11 or filling mouthpieces 36 on the bag turret 35. Each pressing chamber 14 is assigned a pressing wall 20. In addition, each pressing chamber 14 is provided with a flap 23. However, the two flaps 23 of the portion unit 38 are moved by a common, centrally located actuating rod 28.

The plate-like press rams 34, assigned to the two pressing chambers 14, are provided on a common crossmember 40 by way of their top end. This crossmember, in turn, can be displaced laterally on upright guide rods 43, 44 by way of sliding pieces 41, 42.

A crank mechanism is provided as the drive for the (two) press rams 34. Said crank mechanism comprises a connecting rod 45, which is connected in an articulated manner to the rotatably mounted cam segment 30. Partial rotation of the cam segment 30 thus produces, via the connecting rod 45 movement of the crossmember 40, and thus of the press rams 34, up and down.

The displacement of the press ram 34 can be adjusted with regard to the pressing position according to FIG. 2. The connecting rod 45 is anchored releasably on the crossmember 40 via a manually actuable rocker lever 46. Once the rocker lever 46 has been released, the displacement motion of the press ram 34 can be altered. By displacing the connecting rod, the displacement of the press ram 34 is altered to such a degree that the lower pressing position in the region of pressing chambers 14 can be displaced downwards (smaller format of the compacted portion 10) or upwards (larger format of the compacted portion 10).

Once the portion 10 has been introduced into the bag 11, the bag turret 35 is moved into a closing station. Elements of the latter are shown in simplified form in FIGS. 5 to 7.

The bag 11, which has been filled but is open at the top, is retained, in the region of the closing station, in a pocket 47 which is open at the top. Said pocket comprises a fixed, upright side wall 48, a mating wall 49, which can be moved into a funnel-like open position (FIG. 5), and a base wall 50, which corresponds to the profile of the bag 11, in the present case is designed in the form of a V and is connected to the fixed side wall 48.

The bag is introduced into the open pocket 47 (FIG. 5) from above. Via the bag opening 37, a pressure-exerting element, namely a pressure-exerting plate 51, is introduced into the pocket 47 from above in order to position the (compacted) portion 10 precisely within the bag 11. The dimensions here are such that a projection of two mutually opposite lateral bag walls 52, 53 is produced above the portion 10. At the bottom, the bag 11 butts against the base wall 50 in a positively locking manner.

Once the bag 11 has been introduced, the pocket 47 is closed by the mating wall 49 being moved into a position parallel to the side wall 48. Then pressure-exerting elements which are arranged above the side wall 48 and mating wall 49, and are preferably connected to these walls, take effect. These elements are profiled pressure-exerting strips 54, 55, which can be moved, above the portion 10, against the bag walls 52, 53 from the outside such that top pressure-exerting edges 56, 57 butt against the bag walls 52, 53 and compress the latter. The profile of the pressure-exerting strips 54, 55 is selected such that a bottom cross-sectional region butts against the bag walls 52, 53 with shaping action, that is to say leaving a wedge-shaped recess in the process.

The bag walls 52, 53 butt directly against one another in a region above the portion 10. Sealing elements, namely sealing strips 58, 59, then take effect in this region. These sealing strips produce a transversely directed closure seam in the region of the bag opening. By virtue of the action of the pressure-exerting strips 54, 55, said closure seam may be provided in a pressure-free manner and without being adversely affected in any way by parts of the portion 10.

The then finished and filled bags 11 are fed to other stations for further processing, namely for completion.

A further special feature of the apparatus can be seen from FIGS. 8 and 9, and concerns the production of the bags 11. These are produced from a continuous material web 60, the latter preferably being a heatweldable material, with the result that side seams of the bags 11 can be produced by sealing. Unless described differently hereinbelow, this arrangement can be designed in the manner of U.S. Pat. No. 4,680,024.

For the purpose of producing bags 11 for receiving a portion of tobacco, the material web 60 is pre-folded in the form of a V, to be precise with legs of different lengths for forming the bag 11 and a longer closure tab 61 on one side. The material web 60 which is pre-folded in this way is drawn off from a reel (not shown) by advancement rollers 62 and fed to a web pendulum 63. By virtue of appropriate movement, the latter controls the tensioning in the material web 60.

The material web 60 is fed to a treatment unit, namely a welding station 66, via deflecting rollers 64, 65. In the region of said welding station, the material web 60 is provided, during a standstill phase, with weld or sealing seams, namely in particular transversely directed side seams for the bags 11 which are to be produced. The welding station 66 is designed such that seals for four bags 11 following one after the other within the material web 60 are produced during one operating cycle. Thereafter, the welding station 66 is opened and the material web is advanced by a corresponding section.

The material web provided with the side seams for the bags 11 is fed to a cutting station 70 via a deflecting roller 67 which adjoins the welding station 66 and via further deflecting rollers 68 and 69. In the region of said cutting station, the individual bags 11 are severed one after the other from the material web 60, by transversely directed severing cuts. The severing cuts are provided in the region of the transverse or side seams of the material web 60. The severed bags 11 are fed by a bag conveyor 71, namely a (suction) belt, to the respectively available receiving means for the bags on the bag turret 35.

A special feature of the arrangement consists in that movement compensation takes place in the region upstream and downstream of the welding station 66. While the material web 60, upstream of said processing station, is conveyed in a stepped manner by a section corresponding, for example, to four bags 11, the (section-by-section) advancement of the material web 60 in the region of the cutting station 70, and upstream of the latter, only corresponds to the length of a single bag 11.

These different movement sections of the material web 60 are compensated for by a compensating element. The latter comprises a carriage 72 which can be moved back and forth. Regions of the material web 60 which are upstream and downstream of the welding station 66 run over this carriage, to be precise via the deflecting roller 64, on the one hand, and the deflecting roller 69, on the other hand, on either side of these deflecting rollers 64 and 69, the material web 60 runs along a section in parallel strands.

The carriage 72 can be moved back and forth with the deflecting rollers 64 and 69, to be precise from the right-hand position, which is shown in FIG. 8, into an opposite end position adjacent to the deflecting roller 68. In the position shown in FIG. 8, in which the carriage 72 is remote from the outlet side of the material web 60 from the welding station 66, a web supply 73 which has formed begins to be drawn off step by step by (short) web sections being fed to the cutting station 70. In the example outlined, this involves four conveying steps of the material web 60 for severing the four bags 11. In this process, the carriage 72 has moved into the other end position, adjacent to the deflecting roller 68.

The treatment in the welding station 66, namely the sealing of the material web 60, have been carried out during this time. A corresponding section of the material web 60 is then released from the welding station 66, a new section of the material web 60 simultaneously being conveyed into the welding station. In this process, the carriage 72 moves from the position adjacent to the deflecting roller 68 (which position is not shown) to the position which is shown in FIG. 8.

The advancement of the web is monitored by (contactless) sensing elements, namely by a photocell 74. In the present case, the latter is positioned on the inlet side upstream of the welding station 66. The photocell 74 reacts to correctly positioned printing marks 76 on the material web 60. A further photocell 75 is arranged upstream of the cutting station 70 in order to control the advancement length for this cutting station 70.

A special feature of the arrangement consists in that these changes in length in the material web 60 caused by expansion or shrinkage are sensed and compensated for. In the case of plastic films in particular, such changes in length can occur as a result of expansion of the material web 60.

For this purpose, in the apparatus, the length of the material web 60 which is actually conveyed is (additionally) established. In the case of the present exemplary embodiment, at least one of the deflecting rollers, namely the deflecting roller 67 positioned at the outlet of the welding station 66, is provided with a monitoring element for establishing the length of material web 60 which is actually conveyed. This element is preferably a known, conventional resolver 77, that is to say an angular encoder. The latter gives a precise measurement of the web length conveyed with reference to the revolutions of the deflecting roller. Any differences as a result of expansion of the material web 60 result in the printed mark 76 being offset (FIG. 9). This difference is compensated for during advancement of the next section of the material web 60, to be precise it is best compensated for by an appropriate, reduced advancement length. This also results in offset relative positioning of the carriage 72 in one end position or the other (FIG. 9).

The movement compensation for the differently conveyed regions of the material web 60 and the arrangement for compensating for changes in length in the material web 60 may also be used for packaging machines in some other connection.

We claim:

1. Apparatus for filling bag packs with portions (10) of fibrous cut tobacco material, which are measured out by quantity and/or weight and introduced, via a pressing chamber (14), into a bag (11) which is open at the top, the pressing chamber, for compressing the portion (10), having at least two movable chamber boundaries, including a movable pressing wall (20) and a press ram (34) which can be moved in a transverse direction with respect to the pressing wall and, once the pressing wall has been moved into the pressing position, can be lowered as far as a fixed (bottom) pressing position: and for the purpose of producing the bags (11), a continuous material web (60) can be transported with different movement characteristics upstream and downstream of a treatment station, with different stepped advancement lengths, and the differences in movement are compensated for by a movable compensating element, being a carriage (72) which can be moved back and forth; characterized in that a region of the material web (60) which is upstream of the treatment station (66), on the one hand, and a region of the material web (60) which adjoins the treatment station, on the other hand, each runs via deflecting rollers (64, 69) of the carriage (72).

2. The apparatus of claim 1 wherein said treatment station (66) is a welding station.

3. Process for producing bag packs, each having a portion (10) of fibrous cut tobacco material, compressing the steps of:

measuring out by weight a portion (10) of the fibrous material;

compressing the portion (10) of the fibrous material in a pressing chamber (14); and introducing the compressed portion (10) into a bag open at the top, and closing the bag, characterized in:

deforming the portion (10) into a downwardly converging shape with a bottom converging profile (18), and that, for the purpose of producing bag packs with portions of different weights, use is made of bags (11) of standard size, and the portion (10) which is to be introduced in each case is compressed such that the bag (11) is filled by the portion (10) irrespective of the weight of the latter.

4. Process according to claim 3, characterized in that the portion (10) is compacted in a pressing chamber (14) in two directions which are oriented transversely with respect to one another, such that, for a flat, approximately cuboidal portion (10), portion (10) is initially compressed to a flat form and is then compacted in a transverse direction by pressure being exerted on a narrow top side (17).

5. Apparatus for filling bag packs with portions (10) of cut tobacco fibrous material, said portions (10) being measured out by quantity and/or weight and introduced into a bag (11) which is open at the top via a pressing chamber (14), characterized by the following features:

(a) the pressing chamber (14) for compressing the portion (10) has at least two movable chamber boundaries, including a movable pressing wall (20) and a movable press ram (34), (b) the press ram (34), once the pressing wall has been moved into the pressing position, can be moved in a downward direction into the pressing position while compressing the portion (10), (c) a bottom slit-like outlet opening of the pressing chamber (14) is closed off by a movable closure element, in the form of a pivotable flap (23), (d) in its closed position, at the lower end of the pressing chamber (14), the flap (23) is arranged in a downwardly directed oblique position so that the pressing chamber (14) exhibits a downwardly converging cross-sectional profile in the region of the flap (23), (e) with the continuous downward movement of the press ram (34) and the attainment of an adjustable relative position of the press ram (34), the flap (23) can be moved out of the closing position in the region of the pressing chamber (14) in such a way that the portion (10) can be pushed out of the pressing chamber (14) by the press ram (34) by continuous downward movement and inserted into a bag (11) which is open at the top.

* * * * *